US005816328A

United States Patent [19]

Mason et al.

[11] Patent Number: 5,816,328

[45] Date of Patent: Oct. 6, 1998

[54] FLUID ADDITIVE SUPPLY SYSTEM FOR FIRE FIGHTING MECHANISMS

[75] Inventors: Thomas E. Mason, Washington, Ind.; Dennis Crabtree, Beaumont; Kenneth Baker, Port Neches, both of Tex.

[73] Assignee: Williams Fire & Hazard Control, Inc., Mauriceville, Tex.

[21] Appl. No.: 427,333

[22] Filed: Apr. 24, 1995

(Under 37 CFR 1.47)

[51] Int. Cl.[6] ..... A62C 5/02

[52] U.S. Cl. ..... 169/15

[58] Field of Search ..... 169/15

[56] References Cited

U.S. PATENT DOCUMENTS 4,436,487 3/1984 Purvis et al. .

4,899,825 2/1990 Bosoni et al. ..... 169/15

5,009,244 4/1991 Grindley et al. ..... 169/15

5,174,383 12/1992 Haugen et al. ..... 169/15

*Primary Examiner*—Gary C. Hoge

*Attorney, Agent, or Firm*—Sue Z. Shaper; Butler & Binion, L.L.P.

[57] ABSTRACT

An additive supply system for fire fighting mechanisms such as a fire fighting truck including an additive supply line system having a pump and a recirculation line, a balanced pressure valve metering flow in the recirculation line and in communication with the measure of additive line pressure and fire fighting fluid line pressure, and additive pump control apparatus connected to the additive pump and in communication with the measure of the degree of openness of the balanced pressure valve.

21 Claims, 5 Drawing Sheets

FLUID ADDITIVE SUPPLY SYSTEM FOR FIRE FIGHTING MECHANISMS

FIELD OF INVENTION

This invention relates to fluid additive supply systems for fire fighting mechanisms, and in particular, to systems for adding foam concentrate into water lines, such as at nozzles on a fire fighting truck.

BACKGROUND OF INVENTION

Fire fighting mechanisms, such as fire fighting trucks, are typically comprised of a source of water, the primary fire fighting fluid, connected to a water pump that supplies a plurality of nozzles or discharge outlets. Each nozzle, or outlet, usually contains its own valve for placing the nozzle or outlet in or out of service.

Frequently there is provided at each nozzle or outlet an inlet port and valving mechanism for the intake of an additive, such as a foam concentrate solution. The intake port for the additive usually contains a valve for turning on or off the additive supply system and, if "on", for selecting the appropriate amount of additive to meter into the water line. For example, foam concentrate might be metered into a water line at either 3% or 6%.

To add the correct amount of additive into the fire fighting fluid line, such as at the nozzle, the system must supply additive at approximately the same pressure as the pressure of the fluid being delivered through the fluid line.

Various systems presently exist to supply additive at what is sometimes referred to as a "balanced" pressure, taking into account that the pressure in the fluid or water line can vary significantly and frequently due to a variety of factors, such as the number of nozzles in service. The traditional system to supply "balanced pressure" additive has been to place the additive in a bladder that is placed inside a container filled with water at the pressure of the water in the fluid line. This system insures that the additive is supplied from the bladder at the same pressure as the current water pressure. However, such system has drawbacks. It is cumbersome and difficult to deal with when more additive is required than can be contained in one bladder, which is ever more frequently the case.

Other "balanced pressure systems" have developed in the art that involve an additive pump. These pump systems are of one or two basic types. One type, a bypass system, utilizes a balanced pressure valve located in a recirculation line connected to an additive supply powered by a fixed output pump. The balanced pressure valve controls effective additive discharge pressure by bypassing, or recirculating, a portion of the additive back to the source. Such a bypass system is also quite accurate in balancing pressure. It has operating limits, however, in the amount of water pressure variation it can accept and retain accuracy.

A hydraulically powered "demand" system, alternately, has been developed to vary additive pump output directly. This system directly controls additive line pressure. A "direct injection" proportioning system has also been developed, utilizing a variable output additive pump to inject additive directly into the water pump discharge line in response to electric signals. A meter installed in the water pump discharge line measures water flow rate. This flow meter signal is processed by a microprocessor to match the output of the flow on the additive pump with a measure of the additive pump output fed back to the microprocessor to maintain the additive flow rate at the proper proportion to the water flow rate.

Although more complex in design, these "demand" balanced pressure proportioning systems, utilizing a variable output additive pump, have the advantage that there is no limit on water inlet pressure to restrict their operating range. Their accuracy generally does not compare, however, with the accuracy of a "bypass" or a "bladder" system.

The instant invention combines the favorable attributes of accuracy of a "bypass" system with the versatility in range of a "demand" system. Preferably, the present invention utilizes electric controls, such as found in direct injection proportioning devices, with manual backup. More particularly, the present invention incorporates the benefit of a highly accurate balanced pressure valve permitted to operate in its optimum range on a recirculation line into a system having the versatility provided by incorporating a variable output additive pump. By allowing a balanced pressure valve to operate within its optimum mid range, problems of hunting or hystresis sometimes encountered with a balanced pressure valve or other systems are greatly alleviated.

The invention also incorporates a further advantage of a recirculation line. Modern fluid additives frequently comprise "thixotropic" foam concentrates. Thixotropic foams have a relatively high viscosity, i.e. they gel, when left stationary or relatively stationary, but have a liquid like viscosity when sufficiently agitated. One advantage of a recirculation line is that it permits a portion of the additive to be continuously circulated thereby tending to maintain the additive in an agitated supply state of liquid-like viscosity, even when there is low demand and/or low pressure.

Electric sensors characteristic of direct injection systems are preferably used in the present invention to sense the degree of openness of the balanced pressure valve. When necessary, the sensors signal a step up or step down to the additive pump output in order to permit the balanced pressure valve to continue to operate in its optimum mid-range. A manual backup system is provided in case the battery operated electric control system malfunctions or fails.

SUMMARY OF THE INVENTION

The present invention comprises an additive supply system for fire fighting mechanisms. A fire fighting truck is an exemplary mechanism. The invention includes an additive supply line system including an additive pump and a recirculating line. A balanced pressure valve governs flow on the recirculating line depending upon the balance of pressure in the additive line and the fire fighting fluid line. Additive pump control apparatus can step up or down the output of the additive pump as signaled by a measure of the degree of openness of the balanced pressure valve.

The invention includes a method for supplying additive to fire fighting mechanisms such as a fire fighting truck. The method includes supplying a fire fighting fluid at variable pressures and additive to the fluid at a pressure varied to comply with the fire fighting fluid line pressure. Supplying the additive includes variably pumping fluid additive from a source, recirculating a portion of the additive pumped to attempt to balance pressure between a portion of the additive line and a portion of the fire fighting line. The additive pump output is varied to permit the recirculating system to operate in a mid-range.

In preferred embodiments the fluid additive is a foam concentrate, probably a thixotropic material.

The additive pump may be of a fixed displacement variable speed or variable displacement type. The control mechanism governing the additive pump may govern displacement of a variable displacement hydraulic pump powered by a vehicle power take-off where the hydraulic pump drives the hydraulic motor driving the additive pump. Alternately, the additive pump control apparatus may include a control mechanism for governing the rate of rotation of displacement vanes with respect to a constantly moving shaft in the additive pump, the additive pump shaft being powered by the vehicle power take-off.

Alternately again, the additive pump control apparatus may include a control mechanism governing the displacement of a variable displacement additive pump powered by the vehicle power takeoff. The displacement of the additive pump may be varied by varying a vane angle.

The invention includes a manual control for raising and lowering the output of the additive pump in order to permit the balanced pressure valve metering flow in the recirculation line to operate in its optimal mid-range.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENTS

Figure 1:
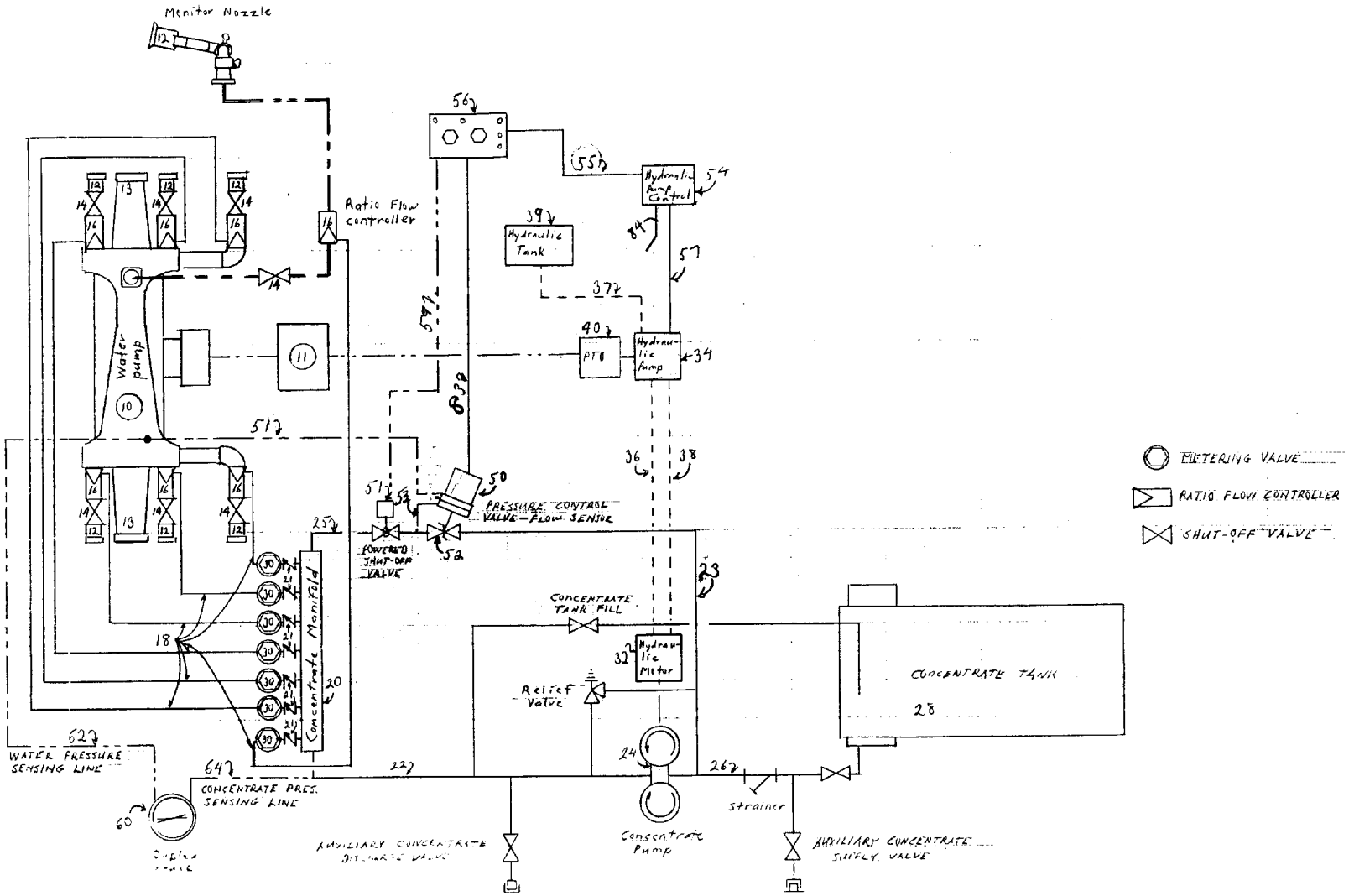
FIG. 1 offers an illustrative view of components of an additive and water supply system on a fire fighting truck, including supply lines, or the supply line system.

FIG. 1 illustrates schematically a preferred embodiment for the present invention's additive supply system for fire fighting mechanisms. Additive, such as foam concentrate, is stored in concentrate tank 28. The fire fighting fluid of the embodiment of FIG. 1 is assumed to be water. Water is drawn from any convenient source through input orifices 13 and pumped by water pump 10, illustrated as driven by motor 11. Water flows through supply lines to discharge outlets or nozzles 12. The water could be fresh, brackish or sea water. An array of discharge ports 12 is illustrated, including a monitor nozzle.

The foam concentrate, comprising the additive, could be a thixotropic foam concentrate containing polysaccharides or heteropolysaccharides. These are preferred in the fire fighting art for use in the extinguishment of hydrophilic flammable liquids such as acetone, isopropanol, ethanol, methanol or tetrahydrofuran. The fire fighting system of the embodiment of FIG. 1 is particularly adapted for extinguishing flammable liquid fires and for suppressing flammable, toxic or other hazardous vapors or gases.

Discharge ports 12 of the embodiment are shown having shut-off valves 14 and ratio flow controllers 16. Valves 14 open and close discharge ports 12. Ratio flow controllers 16 enable the proper admission of the additive into the discharge port conduits via discharge conduits 18 of the additive supply line. Ratio flow controllers 16 are typically of a modified venturi design to create a lowered pressure zone in the discharge conduit, thereby assisting even thixotropic fluids to be admitted at flow rates directly proportional to the flow rate of the water being pumped through the conduit when valve 14 is open.

Additive supply line discharge conduits 18 lead upstream from ratio flow controllers 16 to the ports of manifold 20 located on the additive supply line. Check valves 21 on supply lines 18 prevent reverse flow of additive. Typically, additive supply line discharge conduits 18 contain metering valves 30. Metering valves 30 operate to either isolate ratio flow controllers 16 from the concentrate pump or, when open, to meter flows through lines 18.

Manifold 20 in the additive supply line is connected to additive pump 24 by conduit 22. Additive pump 24 is connected upstream, by conduit 26, to additive concentrate tank 28.

In the preferred embodiment, additive pump 24 is illustrated as powered by a hydraulic drive and control mechanism which comprises hydraulic motor 32 and variable output hydraulic pump 34. Hydraulic motor 32 may be of any known design, such as the "Eaton Hydrostatic Motor Model 33 through Model 54" manufactured by the Eaton Corporation Hydraulics Division of Eden Prairie, Minn. Hydraulic motor 32 may be mechanically coupled to additive pump 24 and placed in hydraulic fluid communication, via feed and return lines 36 and 38 respectively, with variable displacement hydraulic pump 34.

Hydraulic pump 34 may also be of known design, as for example the "Eaton Corporation Pump Model 33 through model 54" manufactured by the Eaton Corporation Hydraulics Division of Eden Prairie, Minn. Both the hydraulic pump and hydraulic motor are of a design known to those in the art of hydrostatic drives. The hydraulic pump includes an internal rotary gear charge pump and can be driven, for instance, via an input shaft of power take-off 40 of motor or engine 11, or by any other power source. The system would be adjusted to prevent reverse rotation of the additive pump.

Hydraulic pump 34 would be connected by suction line 37 to a hydraulic fluid reservoir tank 39. The speed of rotation of hydraulic motor 32 varies directly with the output of hydraulic pump 34, thereby varying the output of additive pump 24.

When system control panel 56 is in an off position, power take-off 40 would be disengaged, no additive would flow, and hydraulic pump control 54, preferably, would receive a signal through electrical conduit 55 to move control cable 57 for a lowest speed setting, preferably zero, of hydraulic pump 34 in preparation for next use.

When system control panel 56 is set for automatic operation, the speed of rotation of the hydraulic drive, and hence the output of additive pump 24, can be affected by "openness" monitors or sensors 50, attached to balanced control valve 52, as discussed more fully below.

When control panel 56 is first placed in the automatic position, a control signal is sent via electrical conduit 59 to a powered shut-off valve 51, causing it to open and allow recirculation flow through balanced pressure valve 52 and recirculation line 23. The PTO engages hydraulic pump 34 causing additive pump 24 to operate, at first, preferably, at a pre-set lowest level.

Figure 2:
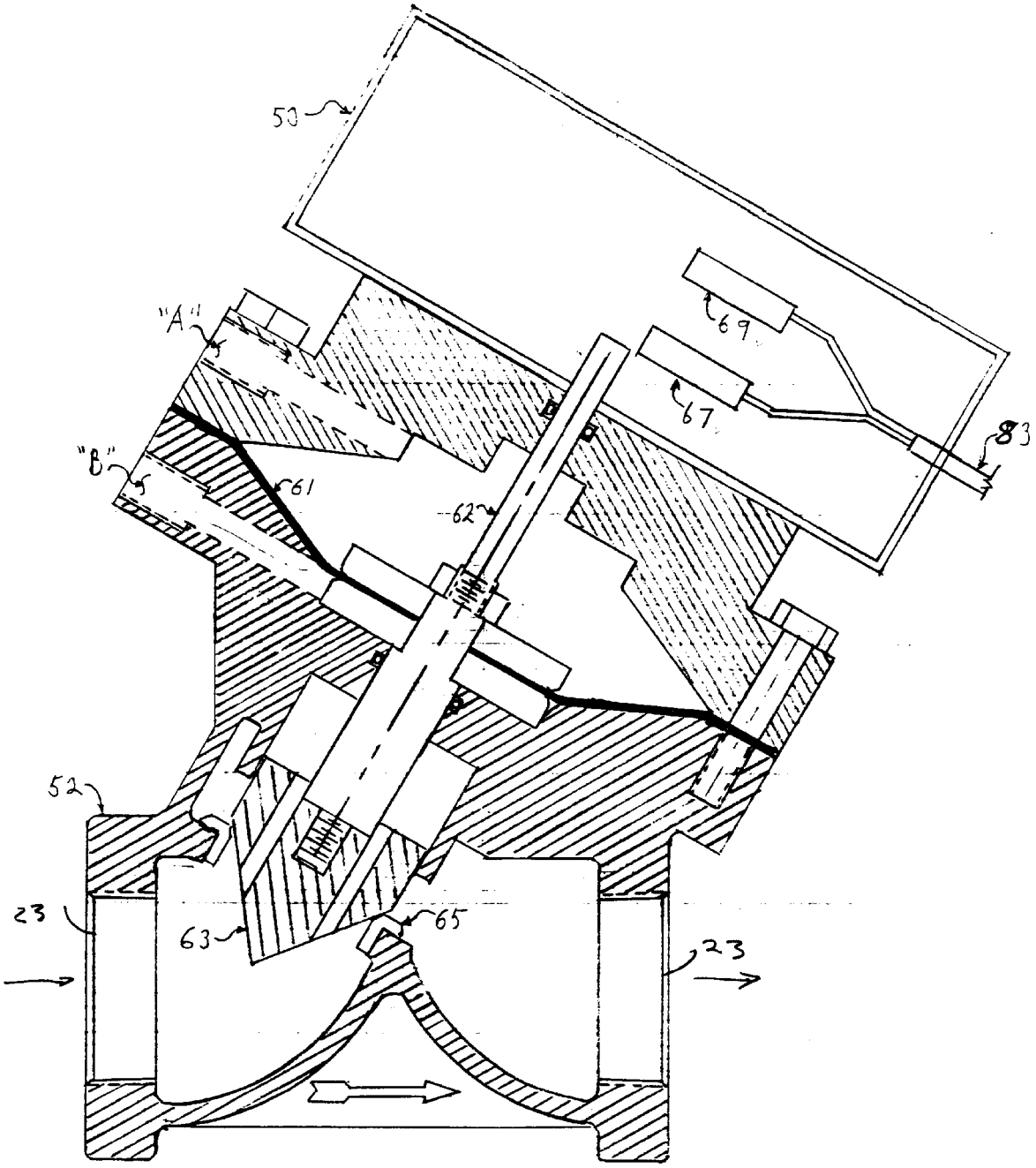
FIG. 2 illustrates, in cutaway, a pressure balancing valve flow control device valving a recirculation line, together with sensors for monitoring the degree of openness of the valve.

As more clearly illustrated in FIG. 2, balanced pressure valve 52 is sensitive to a measure of water pressure generated by water pump 10 and a measure of downstream additive pressure in recirculation line 25 leading out of manifold 20. Assuming water pressure is initially significantly higher than additive pressure in manifold 20, such as the situation when the additive pump is set on its lowest position when off and the system is first turned on, piston 63 of balanced pressure valve 52 will tend to move against seat 65. This inhibits flow through the portion of recirculation line 23 that passes through balanced pressure valve 52. Assuming additive pump 24 is running, back pressure should build up in the additive supply line such that the measure of additive pressure received at balanced pressure valve 52 tends to exceed the measure of water pressure received. In such case piston 63 will then lift off of or away from seat 65, and additive will begin to flow or increase flow through recirculation line 23.

Given the water pressure being generated by the water pump and the existing speed of additive pump 24, balanced pressure valve 52 will tend to settle upon an equilibrium position wherein piston 63 rests at a certain degree of openness. If the degree of openness lies within the mid range of the valve's design, say between 30% open to 80% open, pressure is not only balanced but the balanced pressure valve 52 is operating within its optimal range of accuracy. In this circumstance, the speed of additive pump 24 does not change. No control circuit is closed or control signal is sent via line 83 to step up or step down the drive mechanism of pump 24.

If, however, operation of additive pump 24 creates such a back pressure, or lack of it, that piston 63 is driven to 80% or more openness, or to less than 30% openness stem 62 connected to piston 63 will make contact with contacts 69 or 67 in sensor 50.

In the preferred embodiment contact 67, absent any contact with stem 62, closes a circuit. When such circuit is closed signals are sent to speed up additive pump 24. The rising of piston stem 62 into contact with lower contact 67 opens that circuit. Contacts 67 and 69 may be of any type known in the art, including the inductive switching type for increased sensitivity and longer life. When the circuit containing contact 67 is opened, signals will cease to be sent to step up the speed of additive pump 24. Contact 69 lies on an open circuit, absent contact with stem 62. The rising of stem 62 into contact with contact 69 closes the circuit containing contact 69, and causes a signal to the control mechanism for the additive pump to step down the speed of the additive pump. As the speed of additive pump 24 decreases, pressure falls on the additive line, leading to the balanced pressure valve sensing an excess of water pressure over additive pressure. Such a change in the balance of pressure causes piston 63 to tend to descend toward its mid-range of operation. As piston 63 enters its mid-range of operation the circuit containing contact 69 is broken, and no signal is sent to the additive pump 24 to speed up or to slow down. The circuit containing contact 67 remains open unless or until the piston passes through its mid range and tends to close on seat 63. Piston 63 tends to select an equilibrium position wherein the percent of fluid recirculated through recirculation line 23 balances the pressure in valve 52. Experiments have indicated that pressure can be balanced to within 0.5 psi.

A manual option is provided in control panel 56. In manual operation circuits in hydraulic pump control 54 are disabled and the output speed of hydrostatic drive 34 can be varied by moving a manually operated increase/decrease control also provided on control panel 56 (not shown).

Pressure control valve 52 of the preferred embodiment comprises a diaphragm valve where water at the pressure generated by pump 10 enters an upper chamber through port A and tends to force diaphragm 61 and attached shaft 62 and piston 63 toward valve seat 65, thereby restricting flow of additive through valve 52 and recirculation line 23. Concentrate pressure from manifold 20 through conduit 53 enters a balanced pressure valve lower chamber through port B and tends to force diaphragm 61 and attached shaft 62 and piston 63 away from valve seat 65, thereby easing flow of concentrate through valve 52 and tending therefore to decrease concentrate pressure in manifold 20. Diaphragm 61, shaft 62 and piston 63 continue to move toward or away from valve seat 65 until an equilibrium position is achieved wherein water pressure at port A is balanced with and is essentially equal to additive pressure sent through port B. Sensor or monitor 50 is designed to sense the degree of openness of valve 52 and in particular whether valve 52 is operating within its optimally accurate mid-range, which may comprise recirculating between 30% to 80% of additive fluid in the recirculation line 23.

A duplex pressure or differential pressure gauge 60 is also provided to visually indicate water pressure and additive pressure, the same as sensed by balanced pressure valve 52. When the system is operated in an automatic mode, pressure gauge 60 should indicate that water pressure and concentrate pressures have been balanced or equalized to within 0.5 psi by the balanced pressure valve. When the system is operated in a manual mode, pressure gauge 60 will indicate water pressure and concentrate pressure to assist a manual control, either through switch 56 or hydraulic pump control 54, to attempt to equalize pressures. In particular, use of the manual control of pump controller 54 also permits accurate balancing of pressure.

Figure 3:
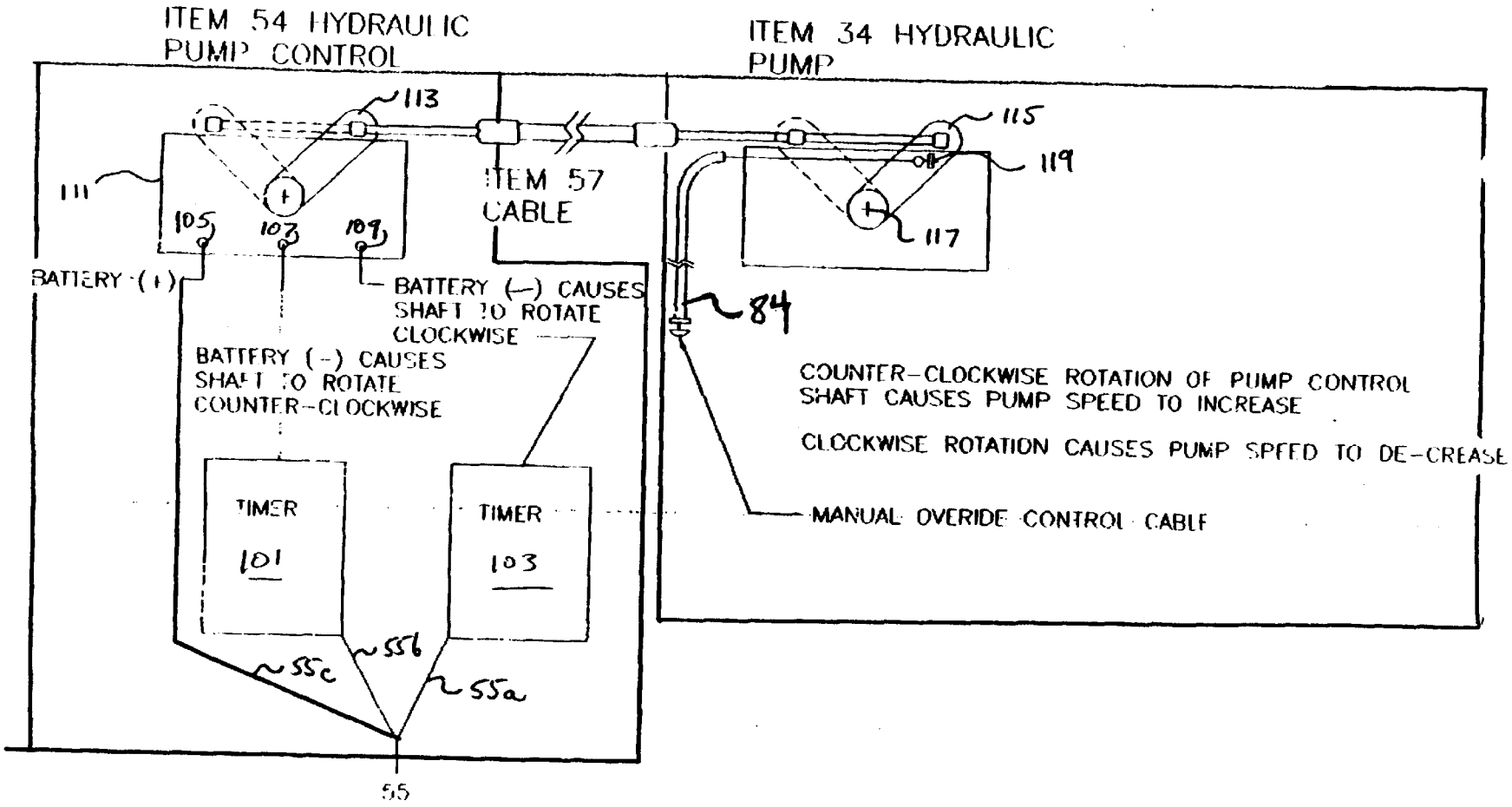
FIG. 3 illustrates schematically elements of a hydraulic pump control for driving an additive pump.

FIG. 3 indicates further details of hydraulic pump control 54 and hydraulic pump 34. A suitable pump controller 54, as is known by those in the field, may be purchased, such as a Frank W. Murphey positioner or mechanical controller. Line 55 comprises, in practice, a set of lines. Line 55*a* indicates a circuit containing contact 69. Line 55*b* indicates a circuit containing contact 67. Line 55*c* brings in battery power from a standard 12 volt dc battery. Timers 101 and 103 delay the actual closing of the circuit between lines 55*a* and 55*b* and contacts 109 and 107 respectively. The delay of timers 101 and 103 is typically in the order of one second. Upon closing the circuit of lines 55*b* or 55*a,* motor 111 causes lever arm 113 to slowly rotate clockwise or counter-clockwise. Rotation of arm 113 causes the lateral movement of cable 57 running between hydraulic pump control 54 and hydraulic pump 34. Within hydraulic pump 34 lever arm 115 follows, essentially, the movement of lever arm 113. Rotation, either counter-clockwise or clockwise, of lever arm 115 rotates clockwise or counter-clockwise shaft 117. In the preferred embodiment rotation of shaft 117 changes the angle of attack, and thus the displacement of variable displacement hydraulic pump 34.

Manual override 84 is provided by contact 119 with lever arm 115. If the electric system should malfunction, for instance, displacement of hydraulic pump 34 can be varied through lever 84 providing for manual adjustment of lever arm 115. If power shut off value 51 is biased to a closed position upon the loss of power, for safety reasons, a manual override can be provided to open recirculation lines 25 and 23 flowing through pressure control valve 50.

Figure 4:
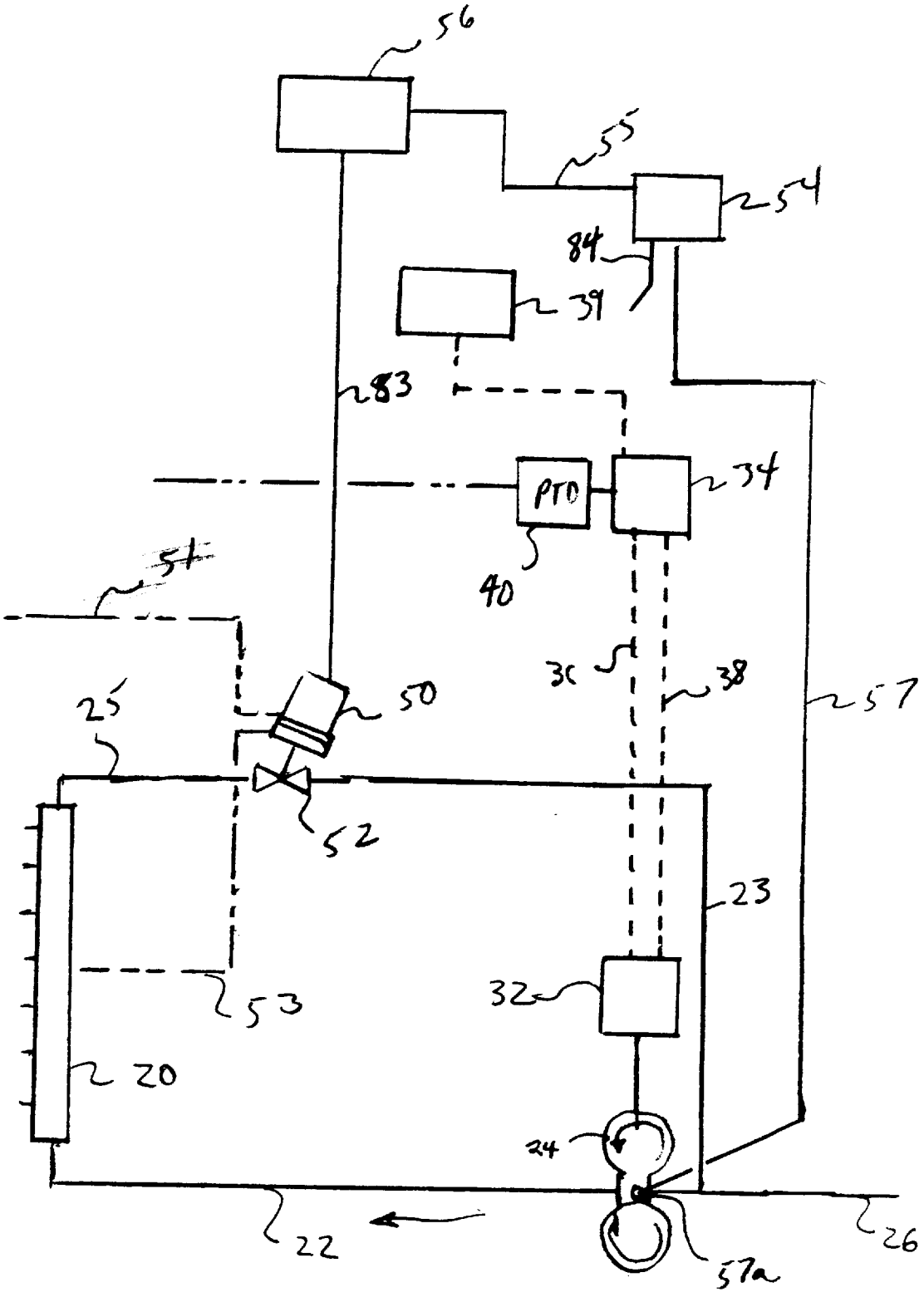
FIG. 4 illustrates portions of the schematic of FIG. 1 employing an alternate additive pump control mechanism.
Figure 5:
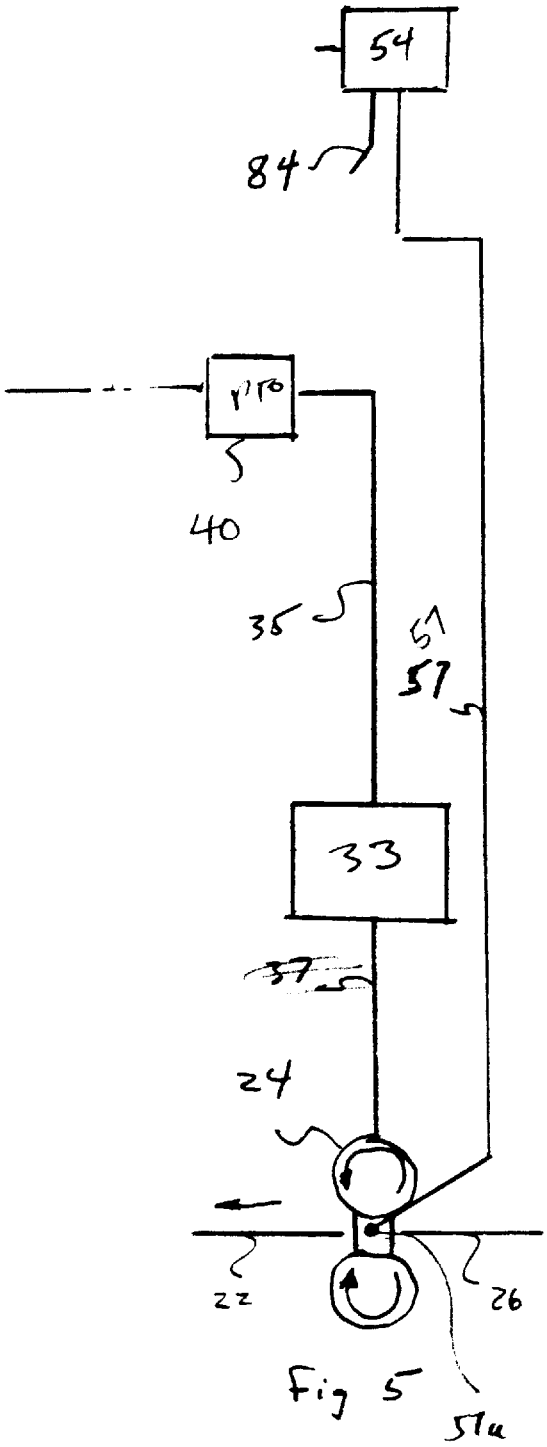
FIG. 5 illustrates portions of FIG. 1 employing a further alternate additive pump control mechanism.
Figure 1:
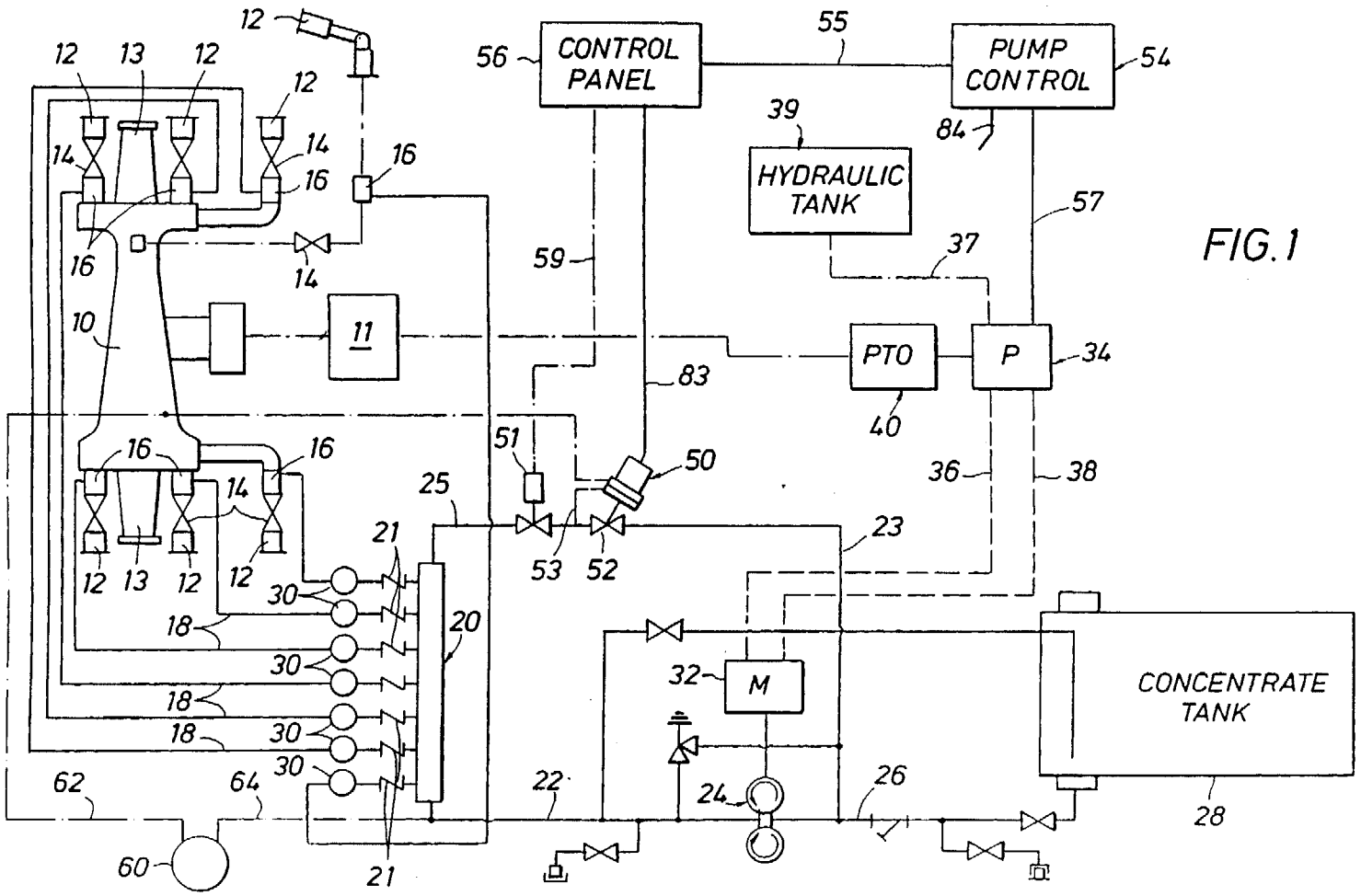
Figure 2:
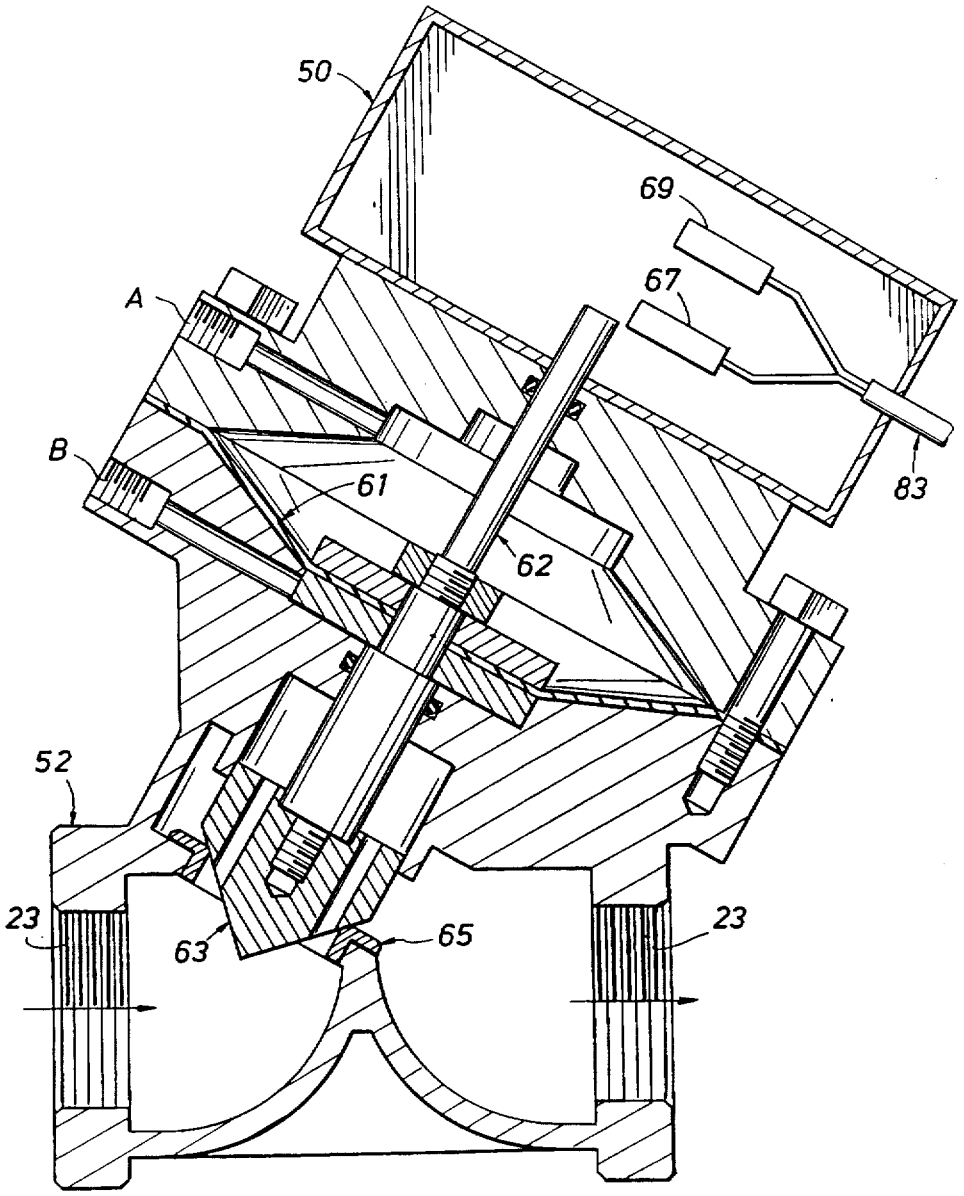
Figure 3:
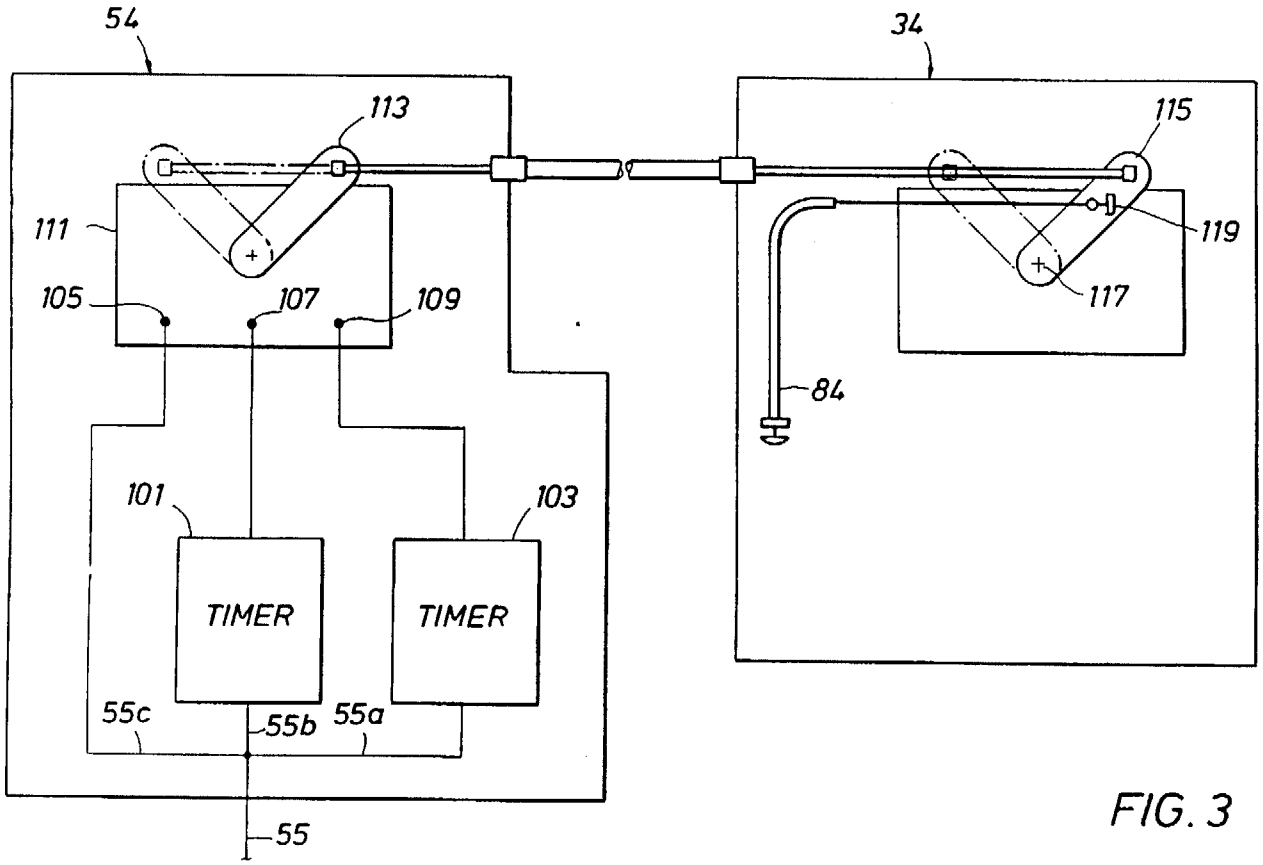
Figure 5:
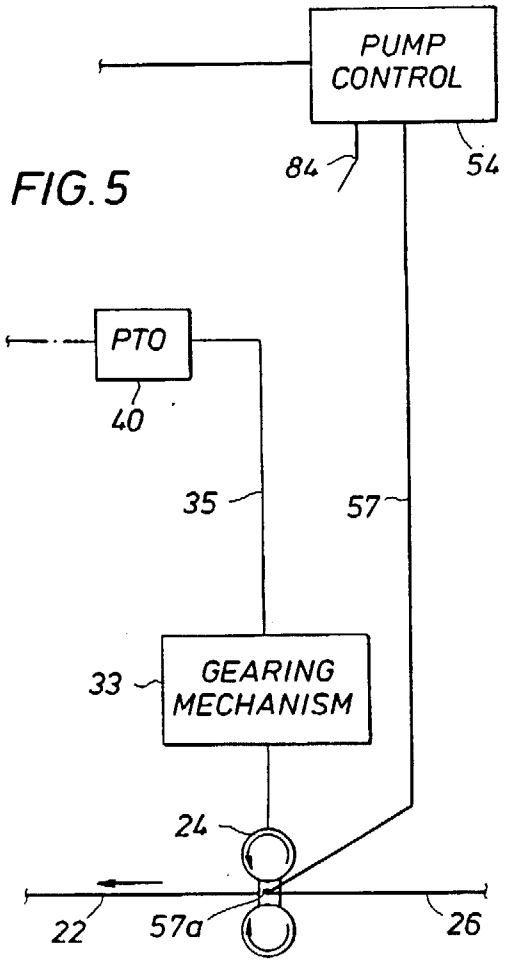
Figure 4:
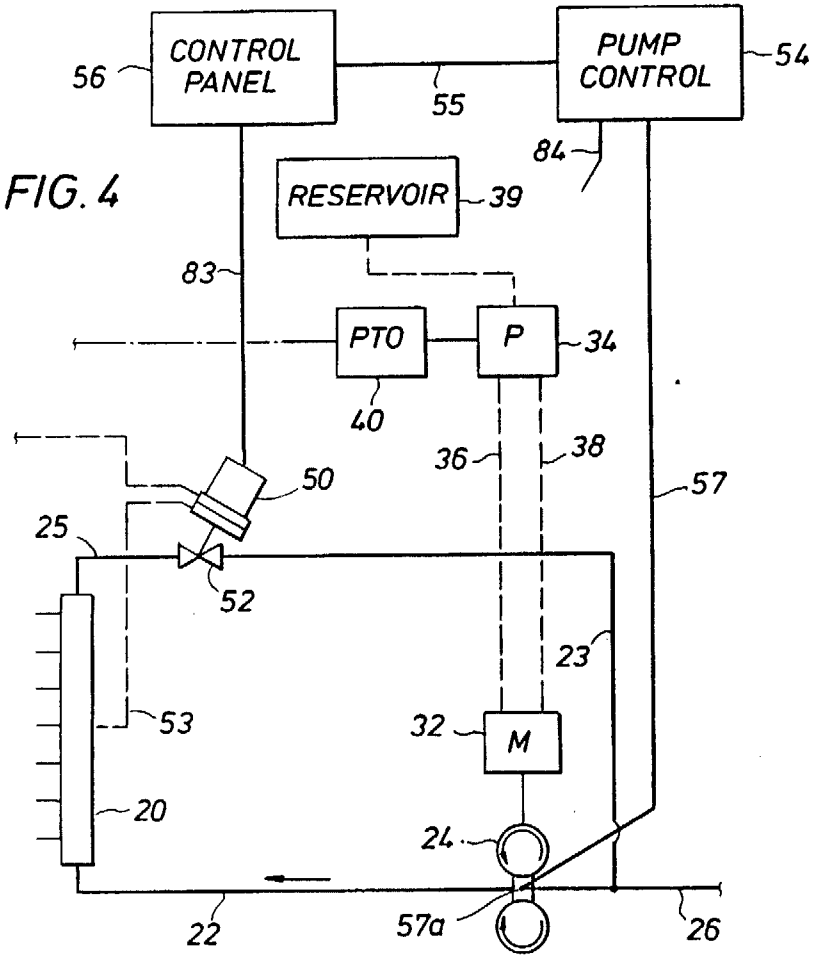

FIGS. 4 and 5 indicate alternate apparatus for controlling additive pump 24. FIG. 4 indicates apparatus for controlling additive pump 24 where hydraulic pump control 54, in lieu of varying the displacement of hydraulic pump 34 as illustrated in FIG. 1, rather directly, through shaft 57A, varies displacement of a variable displacement means, such as the angle of attack of a vane, in additive pump 24. In FIG. 4 additive pump 24 is shown as being rotated at a constant speed by hydraulic pump 34 and hydraulic motor 32 running off of power takeoff 40.

FIG. 5 illustrates a further alternate apparatus for controlling additive pump 24. In FIG. 5 power takeoff 40 through gearing mechanism 33 directly controls the speed of a primary shaft within additive pump 24. Hydraulic pump control 54 through line 57 and contact 57A is illustrated as varying a gear or clutch mechanism that governs the relative rotation of a set of displacement vanes vis a via the main shaft of additive pump 24. As is appreciated by those in the art, a variety of such alternate apparatus for controlling additive pump 24 could be installed utilizing off-the-shelf equipment.

The foregoing disclosure and description of the invention are illustrative and explanatory thereof. Various changes in the size, shape and materials as well as the details of the illustrated construction may be made without departing from the spirit of the invention.

What is claimed is:

1. An additive supply system for fire fighting mechanisms, comprising:

an additive supply line system, connecting a fluid additive source with a fire fighting fluid line, the supply line system in fluid communication with a pump and a recirculating line;

a balanced pressure valve, metering flow in the recirculating line, in communication with a measure of additive line pressure and a measure of fire fighting fluid line pressure; and additive pump control apparatus for variably pumping fluid additive, said apparatus connected to the pump and in communication with a measure of balanced pressure valve openness.

2. An additive supply system for fire fighting mechanisms, comprising:

an additive supply line system, connecting a fluid additive source with a fire fighting fluid line, the supply line system in fluid communication with a pump and a recirculating line;

a balanced pressure valve, metering flow in the recirculating line, in communication with a measure of additive line pressure and a measure of fire fighting fluid line pressure; and means for controlably varying additive pump output, connected to the pump and in communication with a measure of balanced pressure valve openness.

3. An additive supply system for fire fighting mechanisms, comprising:

an additive supply line system, connecting a fluid additive source with a fire fighting fluid line, the supply line system in fluid communication with a pump and a recirculating line;

a balanced pressure valve metering flow, in the recirculating line, in communication with a measure of additive line pressure and a measure of fire fighting fluid line pressure; and additive pump control apparatus for variably pumping fluid additive, said apparatus connected to the pump and in communication with a means for measuring balanced pressure valve openness.

4. A method for supplying additive to fire fighting mechanisms, comprising:

supplying fire fighting fluid through a line at variable pressures; and supplying fluid additive to the fire fighting fluid line at pressures varied to comply with fire fighting fluid line pressures, wherein said supplying includes;

variably pumping fluid additive from a source;

recirculating a portion of the additive pumped from downstream of the additive pump to upstream of the pump to balance the pressure between a portion of the additive line and a portion of the fire fighting line; and varying additive pump output to permit the recirculating system to operate in a mid-range.

5. The apparatus of claim 1 wherein the fluid additive comprises foam concentrate.

6. The apparatus of claim 1 wherein the fluid additive comprises a thixotropic material.

7. The apparatus of claim 1 wherein the fire fighting mechanism comprises a fire fighting truck.

8. The apparatus of claim 1 wherein the fire fighting fluid line comprises a plurality of lines in the downstream direction.

9. The apparatus of claims 1, 2 or 3 wherein the recirculation line connects a portion of the additive line upstream of the additive pump with a portion of the additive line downstream of the additive pump.

10. The apparatus of claims 1, 2 or 3 wherein the additive supply line includes a manifold downstream of the additive pump feeding a plurality of additive supply line discharge conduits and wherein the recirculation line connects a portion of the additive supply line upstream of the pump with a portion of the manifold.

11. The apparatus of claim 1 wherein the additive supply line includes a manifold having a plurality of additive supply line discharge conduits connecting with a plurality of fire fighting fluid downstream lines.

12. The apparatus of claim 11 that includes metering valves in the plurality of additive supply line discharge conduits.

13. The apparatus of claim 1 that includes a modified venturi device connecting a portion of an additive discharge conduit supply line with a portion of a downstream fire fighting fluid line.

14. The apparatus of claim 1 wherein the additive pump comprises a fixed displacement variable speed pump.

15. The apparatus of claim 1 wherein the additive pump comprises a variable displacement pump.

16. The apparatus of claim 1 wherein the balanced pressure valve comprises a diaphragm valve.

17. The apparatus of claim 1 wherein the additive pump control apparatus includes a control mechanism governing a displacement of a variable displacement hydraulic pump powered by a vehicle power take off, the hydraulic pump driving a hydraulic motor driving the additive pump.

18. The apparatus of claim 1 wherein the additive pump control apparatus includes a control mechanism for governing a rate of rotation of displacement vanes with respect to a constantly moving shaft in the additive pump, the additive pump shaft being powered by a vehicle power take off.

19. The apparatus of claim 1 wherein the additive pump control apparatus includes a control mechanism governing the displacement of a variable displacement additive pump powered by a vehicle power take off.

20. The apparatus of claim 19 wherein the displacement of the additive pump is varied by varying a vane angle of the additive pump.

21. An additive supply system for fire fighting mechanisms, comprising:

an additive supply line system, connecting a fluid additive source with a fire fighting fluid line, the supply line system in fluid communication with a pump and a recirculating line;

a balanced pressure valve, metering flow in the recirculating line, in communication with a measure of additive line pressure and a measure of fire fighting fluid line pressure;

a gauge in communication with a measure of additive line pressure and a measure of fire fighting fluid line pressure; and additive pump control apparatus for variably pumping fluid additive, said additive connected to the pump having a manual control for raising and lowering the output of the additive pump.

* * * * *

UNITED STATES PATENT AND TRADEMARK OFFICE

CERTIFICATE OF CORRECTION

PATENT NO. : 5,816,328
DATED : Oct. 6, 1998
INVENTOR(S) : Mason et al.

It is certified that error appears in the above-identified patent and that said Letters Patent is hereby corrected as shown below:

The title page should be deleted to appear as per attached title page.

Please delete drawing sheets 1 of 5 through 5 of 5 and substitute drawing sheets 1 of 4 through 4 of 4 as per attached.

Signed and Sealed this

Ninth Day of March, 1999

*Attest:*

Q. TODD DICKINSON

*Attesting Officer*

*Acting Commissioner of Patents and Trademarks*

United States Patent [19]

Mason et al.

[11] Patent Number: 5,816,328

[45] Date of Patent: Oct. 6, 1998

[54] FLUID ADDITIVE SUPPLY SYSTEM FOR FIRE FIGHTING MECHANISMS

[75] Inventors: Thomas E. Mason, Washington, Ind.; Dennis Crabtree, Beaumont; Kenneth Baker, Port Neches, both of Tex.

[73] Assignee: Williams Fire & Hazard Control, Inc., Mauriceville, Tex.

[21] Appl. No.: 427,333

[22] Filed: Apr. 24, 1995

(Under 37 CFR 1.47)

[51] Int. Cl.[6] ..... A62C 5/02

[52] U.S. Cl. ..... 169/15

[58] Field of Search ..... 169/15

[56] References Cited

U.S. PATENT DOCUMENTS

| | | | |
|---|---|---|---|
| 4,436,487 | 3/1984 | Purvis et al. . | |
| 4,899,825 | 2/1990 | Bosoni et al. | 169/15 |
| 5,009,244 | 4/1991 | Grindley et al. | 169/15 |
| 5,174,383 | 12/1992 | Haugen et al. | 169/15 |

*Primary Examiner*—Gary C. Hoge

*Attorney, Agent, or Firm*—Sue Z. Shaper; Butler & Binion, L.L.P.

[57] ABSTRACT

An additive supply system for fire fighting mechanisms such as a fire fighting truck including an additive supply line system having a pump and a recirculation line, a balanced pressure valve metering flow in the recirculation line and in communication with the measure of additive line pressure and fire fighting fluid line pressure, and additive pump control apparatus connected to the additive pump and in communication with the measure of the degree of openness of the balanced pressure valve.

21 Claims, 4 Drawing Sheets

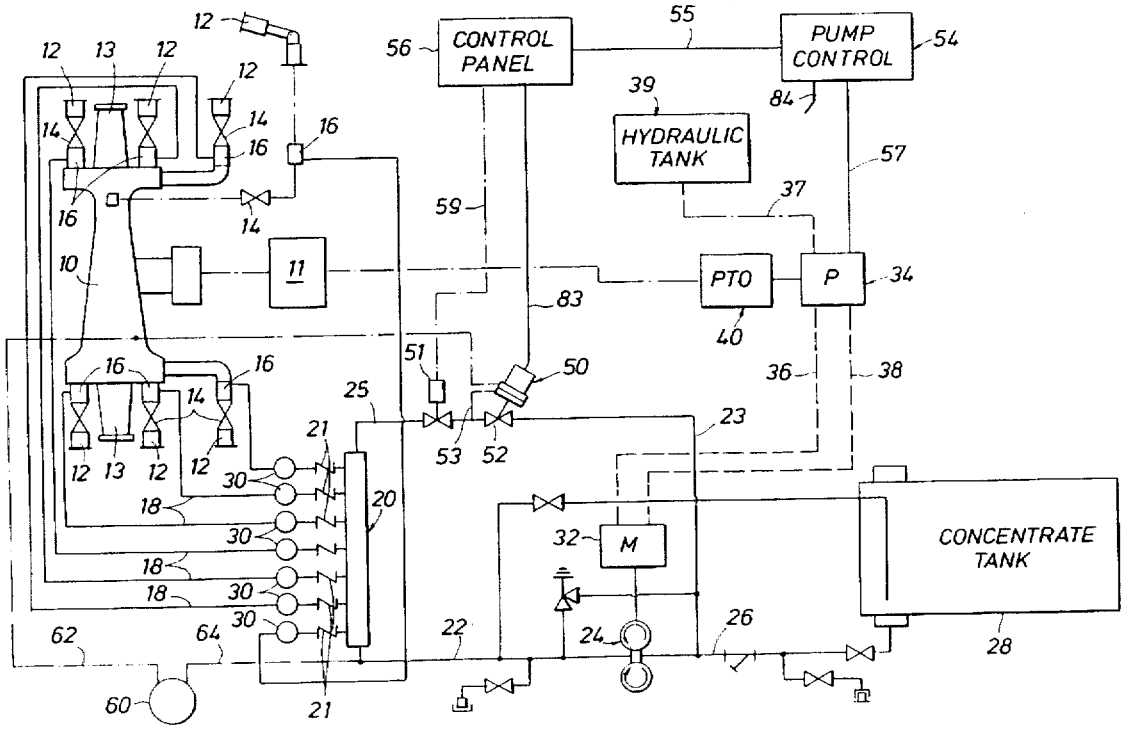

PUMP CONTROL
CONCENTRATE TANK
HYDRAULIC TANK
CONTROL PANEL
P
PTO
M